US006657601B2

(12) United States Patent
McLean

(10) Patent No.: US 6,657,601 B2
(45) Date of Patent: Dec. 2, 2003

(54) METROLOGY ANTENNA SYSTEM UTILIZING TWO-PORT, SLEEVE DIPOLE AND NON-RADIATING BALANCING NETWORK

(75) Inventor: James S. McLean, Austin, TX (US)

(73) Assignee: TDK RF Solutions, Cedar Park, TX (US)

( * ) Notice: Subject to any disclaimer, the term of this patent is extended or adjusted under 35 U.S.C. 154(b) by 0 days.

(21) Appl. No.: 10/032,053

(22) Filed: Dec. 21, 2001

(65) Prior Publication Data

US 2003/0117333 A1 Jun. 26, 2003

(51) Int. Cl.[7] ..... H01Q 9/16
(52) U.S. Cl. ..... 343/792; 343/791; 343/821
(58) Field of Search ..... 343/790, 791, 343/792, 821, 850

(56) References Cited

U.S. PATENT DOCUMENTS 2,286,179 A * 6/1942 Lindenblad ..... 343/791
2,287,220 A * 6/1942 Alford ..... 343/792
2,505,115 A * 4/1950 Hills et al. ..... 343/750
2,594,055 A * 4/1952 Miller ..... 343/792
2,594,839 A * 4/1952 Alford ..... 343/791
2,648,768 A * 8/1953 Woodward, Jr. ..... 343/802
2,748,386 A * 5/1956 Polydoroff ..... 343/787
5,392,055 A * 2/1995 Madnick et al. ..... 343/790
5,554,997 A * 9/1996 Cobb ..... 343/793
6,204,817 B1 * 3/2001 Edvardsson ..... 343/702
6,307,510 B1 * 10/2001 Taylor et al. ..... 343/700 MS
6,351,246 B1 2/2002 McCorkle

* cited by examiner

*Primary Examiner*—Tan Ho
(74) *Attorney, Agent, or Firm*—Darby & Darby

(57) ABSTRACT

The present invention provides a metrology antenna system that combines a sleeve dipole antenna having two coaxial input ports with a balancing network. This combination (1) minimizes or eliminates spurious radiation from the balancing network (2) provides for a symmetric pair of feed regions which may be made arbitrarily small, and (3) provides for an essentially perfect impedance match to a broad range of resistive source impedances. The present invention provides a fabrication of arbitrarily small feed regions such that dipoles can be realized at high frequencies at little manufacturing cost.

20 Claims, 15 Drawing Sheets

300

VSWR vs Frequency

Comparison of Radiation Patterns:
Modified Sleeve Dipole vs. Center-Fed Linear Dipole

Two Equivalent Representations of a Balanced Source

A Balanced Voltage Derived from a Single-Ended Source Using a Transformer as a Balun

CALTS Approach Utilizing Four-Port
180-Degree Hybrid and Center-Fed Linear Dipole Idealized Center-Driven Linear Dipole

Schematic Representation of Center-Drive Linear Dipole

Schematic Representation of Center-Driven Linear Dipole

Traditional Center-Driven Linear Dipole

CALTS Approach for Linear Dipole Implementation

Linear Dipole with Two Symmetrically-Displaced Feeds

METROLOGY ANTENNA SYSTEM UTILIZING TWO-PORT, SLEEVE DIPOLE AND NON-RADIATING BALANCING NETWORK

FIELD OF THE INVENTION

The present invention relates generally to the field of antenna systems. More particularly, the present invention relates to metrology antenna systems. The present invention is intended to serve as a reference radiator or receiver of electromagnetic radiation and provides a near perfect or canonical dipolar radiation pattern.

BACKGROUND OF THE INVENTION

An antenna system consists of radiating/receiving elements as well as a feed network, which couples the radiating elements to an external device, such as an amplifier, or system, such as a receiver. A well-designed antenna system provides an input impedance that closely matches that of the external device or system to which the antenna system is connected at resonance. In this way reflections and standing waves are minimized. Thus, one task of the feed network can be to match the input impedance of the radiating element(s) to the impedance level of the system. Additionally, the feed network may convert a single-ended or unbalanced source into a balanced configuration. This is necessary if the antenna is a symmetric or balanced antenna such as a dipole and the source utilizes a coaxial port. Metrology antenna systems are one type of antenna system that, by design, should produce accurate and repeatable electromagnetic field measurements. Some electromagnetic field measurements include, but are not limited to site attenuation, anechoic chamber characterization, antenna characterization, in-situ telecommunication device characterization, and Specific Absorption Rate (SAR). In a metrology antenna system very little mismatch or imbalance can be tolerated. Therefore, the requirements for the feed network of a metrology antenna system are quite exacting. In order to provide the greatest possible confidence in measurements, it is desirable that a metrology antenna system be capable of being comprehensively modeled numerically or possibly analytically in a straightforward manner. In particular, it is desirable that the antenna system be designed such that well-established and extensively-verified numerical models such as the Numerical Electromagnetics Code (NEC-2, NEC-4) can be used to accurately model it. This limits the geometry of and the materials used in the antenna to those that can be accurately represented in the numerical model. In particular, the NEC code is extremely well adapted to representing linear antennas.

A linear antenna is essentially a one-dimensional antenna, that is, one that looks substantially like a linear wire. Linear antennas, include, but are not limited to, half-wave linear dipoles, quarter-wave linear monopoles, electrically-short linear dipoles, electrically-short linear monopoles, folded dipoles, folded monopoles, sleeve dipoles, and sleeve monopoles. FIG. 9 depicts an idealized center driven linear dipole antenna. As can be see in FIG. 9, the self-contained voltage source $V_o\cos(\omega t)$ feeds the antenna system, which comprises two linear wire elements. Linear antennas are also referred to as wire antennas because sometimes they are fabricated from wire stock or other conducting materials. While it is possible to fabricate linear antennas from wire, such antennas are more often fabricated from rigid metal tubing or circular metal bar stock. One comprehensive reference on linear antennas is R. W. P. KING, THE THEORY OF LINEAR ANTENNAS WITH CHARTS AND TABLES FOR PRACTICAL APPLICATIONS, herein incorporated by reference in its entirety. One such linear antenna is shown in FIG. 9. FIG. 9 depicts a dipole antenna which utilizes a self-contained source. Most practical implementations of dipole antennas do not use a self-contained source. Instead, the antennas are driven via feed transmission lines. In most practical situations, this transmission line is a coaxial cable.

Even though a dipole is a symmetric antenna, it must be driven with a symmetric or balanced source, also known as a differential source in order to obtain a symmetric radiation pattern. As can be seen in FIGS. 10 and 11, the linear dipole, identified by two linear wire elements has a balanced source derived from two single-ended sources, namely the two ½ $V_0(\cos(\omega t))$ voltage sources. Schematic depictions of two equivalent, balanced sources are shown in FIG. 5. A balanced source produces two voltages equal in magnitude and opposite in phase with respect to a common reference. If the sources of a linear dipole are not symmetrically balanced, common mode current will flow on the feed transmission line. Common mode currents produce distorted radiation patterns and cross-polarized radiation thereby eliminating the principle benefit of the linear dipole, namely radiation patterns which are easily modeled. Some references describing these effects are in W. L. WEEKS, ANTENNA ENGINEERING, §4.5 (McGraw Hill 1968) and C. A. BALANIS, ANTENNA THEORY ANALYSIS AND DESIGN," §9.8.6 (John Wiley & Sons 1997) herein incorporated by reference in its entirety.

Accordingly, to prevent common mode currents which produce distorted radiation patterns, linear dipoles must be fed with balanced sources. Sources originally unbalanced may be converted to balanced sources using a BALanced-to-UNbalanced (BALUN) transformer or network. One simple example of a balun is a transformer with a center-tapped secondary, such as is shown in FIG. 6. With this configuration, as shown in FIG. 6, a single-ended source, $V_0(\cos(\omega t))$, is connected to the primary and the center tap of the secondary winding is connected to ground. It should be noted that $V_0$ represents the magnitude of the AC voltage and $\omega$ represents its radian frequency. This produces two voltages equal in magnitude but opposite in phase, namely ½ $V_0(\cos(\omega t))$ and −½ $V_0(\cos(\omega t))$. Linear dipole antennas are usually coupled to coaxial transmission lines through baluns. Some prior art baluns include, but are not limited to, the Marchand or Roberts balun, the choke balun, and the split sleeve balun. The Roberts dipole, a linear dipole driven by a Marchand balun, is a metrology standard and is specified in ANSI standard C63.5-1998, herein incorporated by reference in its entirety. These prior art baluns have a number of inadequacies. As for the Roberts balun these include: (1) calibration procedures using an automatic vector network analyzer are difficult to implement, (2) acceptable manufacturing tolerances for physically small devices such as are required for high frequency operations are difficult to achieve; and (3) spurious radiation from the balun which can significantly perturb the linear dipole's radiation pattern. Choke baluns suffer from drawbacks similar to the Roberts balun. These shortcomings include: (1) the difficulty of implementing a calibration procedure using an automatic vector network analyzer; (2) physical limitations in magnetic materials, such as ferrite, which limit the operating frequency range of such devices to several GHz at the highest; and (3) spurious radiation from the balun.

As noted earlier, in order to increase confidence in electromagnetic field measurements, it is desirable to employ an antenna system that can be simply and accurately modeled analytically or numerically. This is particularly important for metrology or reference antenna systems. Because linear dipoles are among the simplest antenna structures and have been extensively analyzed, they are widely used in conjunction with metrology applications. Despite their simplicity, there are some difficulties encountered in the realization of practical dipole antennas. One difficulty involves the techniques used to feed the dipoles. Radiation originates from these feed mechanisms, and simple numerical and analytical models cannot accurately account for this radiation. Feed region radiation can cause the behavior of a practical dipole to depart markedly from that of an ideal or canonical dipole. Besides the distortion of the ideal canonical dipole radiation pattern caused by the feed source, radiation from the feed source also complicates the interaction of the antenna with its environment. That is, one of the desirable features of a linear dipole is its simple, low-order radiation pattern that allows straightforward prediction of its interaction with a scatterer such as a ground plane. However, spurious radiation from the feed region complicates the practical dipole's radiation pattern and makes prediction of the interaction of the antenna with a scatterer such as a ground plane much more difficult. One prior art method used to prevent radiation caused by the feed regions involved reducing, the dimensions of the antenna feed regions. In order for the feed region not to affect radiation patterns, the feed regions needed to be approximately 0.01 of the size of the overall dipole length. This constraint is easier to satisfy for large dipole antennas such as at HF (3–30 MHz) and VHF (30–300 MHz) frequencies where wavelengths range from 10 meters down to 1 meter, however, for smaller antenna systems at, for example, 3000 MHz, a half-wave dipole is about 5 cm long. Creating a feed region, one hundredth the size of this dipole length is extremely difficult to manufacture and results in a large margin of error. This problem is exacerbated because the center feed region often provides the mechanical support for the dipole elements. To add further mechanical support often times a buttressing material such as shown in FIG. 13 is used to support and maintain the dimensions of the feed regions. However, this buttressing material, dielectric or otherwise, also alters the behavior of the antenna and therefore can cause a departure from canonical dipole behavior. Thus, it is desirable to minimize usage of such material.

A prior art technique for obtaining a shielded and hence a non-radiating balancing network involves the use of a shielded four-port 180-degree hybrid network. FIG. 8 depicts the four-port 180-degree hybrid network employed as a balun in the CALTS approach discussed below. FIG. 8 also demonstrates how the four-port 180-degree hybrid balun can be "connectorized" using standard coaxial connectors such as SMA or N connectors. With standard, 50Ω coaxial connectors, the 180-degree, four port hybrid network can be easily characterized using automatic vector network analyzers. This is the procedure required in the CALibrated Test Site Amendment to the CISPR16-1 1993 (1999, International Electrotechnical Commission) (hereinafter "the CALTS approach") herein incorporated by reference in its entirety. The CALTS approach is depicted in FIGS. 8 and 14. While, the CALTS approach allows the antenna and balun to be "connectorized" and characterized using standard automatic vector network analyzers, the CALTS approach does not provide an effective way to prevent spurious radiation from the feed region. Hence, it is not easily adapted for use at higher frequencies. Moreover, the manner in which the 180-degree, four-port hybrid network is adapted as a balun places two of the ports (the 0° and 180° ports) in series thereby effectively doubling the port impedance. If the hybrid has 50Ω coaxial ports, the effective 100Ω impedance does not match the input impedance of the half-wave linear dipole which is 73–80Ω depending on the diameter of the dipole. In the CALTS approach, this mismatch is remedied by the use of coaxial attenuators.

Prior art techniques, to match the effective source impedances with the dipoles impedance involved resistive matching pads placed between the 0 and 180-degree ports of the hybrid network and the dipole as shown in FIG. 8. The resistive matching pads effect an impedance match by dissipating power. While the resistive pads resulted in a matched network, the resistive pads also resulted in a reduced system gain. Specifically, the use of minimum loss pads to match a 100Ω source such as a 50-Ω, 180-degree hybrid to the resistive 73-Ω input impedance of a resonant, half-wave, linear dipole will result in a 5.00 dB loss in gain and therefore a −3.14 dBi overall gain. Moreover, true minimum loss pads for this particular application are not commercially available. Instead, symmetric coaxial attenuators that are intended to work with equal source and load impedances (usually 50Ω) are commonly available. The CALTS specification calls for the insertion of such coaxial attenuators in between the 180-degree hybrid and the dipole antenna. However, the performance of such attenuators cannot be as good as that of a true minimum loss pad. For example, if 6 dB, 50Ω attenuators were used in between a 180-degree hybrid and a resonant, linear half-wave dipole, the return loss would be −28 dB and the overall gain would be reduced by 6 dB to −4.14 dBi. The signal-to-noise ratio of a measurement system incorporating two such dipole antenna systems (one for transmit and one for receive) would be decreased by 12 dB and, therefore, accurate electromagnetic field measurements would be difficult to achieve in some situations, especially those with high ambient noise levels. Furthermore, the use of resistive matching pads complicated high power antenna implementations such as needed for SAR measurements. In high power antenna implementations, power levels as high as 100 Watts are encountered. Matching pads or attenuators operating at this power level must be physically large in order to provide sufficient surface area for radiation of heat. Scattering from large matching pads further disturbs radiated field patterns. In principle, the impedance match can be implemented using reactive components, such as inductors and capacitors, and hence with minimal dissipative loss. However, practical inductors and capacitors exhibit significant tolerances and thus degrade the precision of the system.

One way to overcome the impedance matching problem between the 100Ω effective output impedance of the 180 degree hybrid and the 73—80Ω input impedance of the center-fed linear dipole is to essentially split the feed of the dipole and then symmetrically displace the two halves from the center as shown in FIG. 15. The effect of displacing the feeds from the center is an upward transformation or scaling of the impedance. This impedance transformation is given approximately by:

$$\frac{Z_{in}}{Z_{center}} = \frac{1}{2}\sec^2(kl_{feed})$$

where $Z_{center}$ is the input impedance of the dipole when driven by a single source at the center, $Z_m$ is the driving point impedance seen at each of the two displaced sources, $l_{feed}$ is the distance each source is displaced from the center, and k is the free space wavenumber associated with the electromagnetic field. By adjusting the distance of the feed regions from the center of the dipole, the impedance seen at each feed can be scaled upward from $$\frac{Z_{center}}{2}$$

over a very wide range. Thus, in the case of a very thin linear, half-wave dipole the impedance may be easily transformed from $$\frac{Z_{center}}{2} = 36.5\ \Omega$$

to 50Ω in order to match the port impedances of a 180-degree 50-Ω hybrid.

Accordingly, it would be advantageous to provide an improved linear dipole antenna system which can be accurately modeled numerically, utilizes a shielded balun which can be calibrated with an automatic network analyzer, the antenna having arbitrarily small feed regions and the antenna system being intrinsically matched to standard system impedance levels without using resistive matching pads or external matching networks.

SUMMARY OF THE INVENTION

The present invention eliminates one of the principal negative limitations associated with prior art dipole designs, which is, the need for resistive matching pads to match source impedances. Rather than using two resistive matching pads, the preferred embodiment of the present invention intrinsically matches the source impedance via the impedance transforming effects of a sleeve dipole antenna having two coaxial input ports and connected to a balancing network. The sleeve dipole antenna has two outer conductors and two inner conductors projecting from these two outer conductors which consequently create two arbitrarily small feed regions at the point where these inner conductors project. This two feed regions are then symmetrically displaced from a center point of the sleeve dipole antenna. By symmetrically displacing the two feed regions from the sleeve dipole antenna's center point, the impedance of the sleeve dipole antenna at resonance increases. By shifting the feed regions, the sleeve dipole antenna's impedance can be altered such that it matches the balancing network's effective impedance at resonance.

In sum, the present invention provides an antenna system which essentially matches at resonance a particular source impedance without the use of an external matching network. In addition, the annular feed regions of the sleeve dipole antenna can be made arbitrarily small at little expense or with few manufacturing complications. Thus, the present invention creates an antenna with a highly predictable dipole radiation pattern without the use of matching pads. Moreover, because the annular feed regions can be made arbitrarily small, this antenna design is suited for high frequency implementations. High frequency implementations, as discussed above, require extraordinarily small feed regions to avoid distortion of the dipole's radiation pattern.

One embodiment of the present invention includes an antenna system intrinsically matching a resistive impedance of a balancing network. The balancing network has a first output port and a second output port driven substantially one hundred and eighty degrees out of phase with respect to one another. The system includes a first transmission line connected to the first output port of the balancing network at a first end. This first transmission line has two ends, one connected to the balancing network as well as a free end. The first transmission line includes an inner conductor and a coaxially disposed outer conductor. In addition, the system includes a second transmission line. This second transmission line is also connected to the balancing network, however the second transmission line is connected to the second output port of the balancing network. Like the first transmission line, the second transmission line also has two ends. One end of the second transmission line is connected to the balancing network and a free end. The second transmission line extends from the balancing network co-linearly with respect to the first transmission line. The second transmission line also includes an inner conductor and a coaxially disposed outer conductor. The system further includes a sleeve dipole antenna having a resistive impedance at resonance. The sleeve dipole has a first input port and a second input port. The free end of the first transmission line is connected to the first input port of the sleeve dipole, while the free end of the second transmission line is connected to the second input port of the sleeve dipole. The sleeve dipole has two feed regions. The feed regions are displaced from the point of connection of the sleeve dipole to the first and second transmission lines. The feed regions are displaced so that the resistive impedance of the sleeve dipole at resonance matches the resistive impedance at the first and second output ports of the balancing network.

Another embodiment of the present invention involves an antenna system for connecting to a balancing network. This embodiment includes a first transmission line removably connected to a first output of a balancing network at a first end, this first transmission line having a free end. In addition, the embodiment includes a second transmission line removably connected to a second output of a balancing network at a first end, this second transmission line also having a free end. Finally, the embodiment includes a sleeve dipole antenna having a first coaxial input port and a second coaxial input port. The free end of the first transmission line is connected to the first coaxial input port of the sleeve dipole antenna while the free end of the second transmission line is connected to the second coaxial input port of the sleeve dipole antenna.

A further embodiment of the present invention includes an antenna system for connecting to a balancing network. This system includes a sleeve dipole antenna having a first inner conductor, a first outer conductor, a second inner conductor and a second outer conductor. The first inner conductor of the sleeve dipole antenna is coaxially disposed within the first outer conductor until a first feed region. This first feed region is created where the first inner conductor projects from the first outer conductor. The second inner conductor is also coaxially disposed within the second outer conductor until a second feed region. Like the first feed region, the second feed region is created where the second inner conductor projects from the second outer conductor. In addition, the system includes a first coaxial cable. The first coaxial cable connects and extends from a center point of the sleeve dipole antenna. In addition, the system further includes a second coaxial cable. This second coaxial cable connects and extends symmetrically with respect to the first coaxial cable from the center point of the sleeve dipole antenna.

BRIEF DESCRIPTION OF THE DRAWINGS

The foregoing and other features of the present invention will be more readily apparent from the following detailed description and drawings of illustrative embodiments of the invention wherein like reference numbers refer to similar elements throughout several views and in which.

DETAILED DESCRIPTION OF THE PREFERRED EMBODIMENTS

By way of overview, the present invention relates to metrology antenna systems. The present invention combines a sleeve dipole antenna having two coaxial input ports with a balancing network. As such the present invention acts as a reference radiator or receiver of electromagnetic radiation, reduces spurious radiation from feed regions with symmetrical, arbitrarily small feed regions, and provides a near perfect or canonical dipolar radiation pattern without the use of resistive matching pads as seen in prior art designs. The sleeve dipole antenna of the present invention has two arbitrarily small feed regions which are displaced from the sleeve dipole antenna's center point. By displacing the feed regions of the sleeve dipole antenna, the impedance transforming effects of the sleeve dipole antenna are altered such that at resonance the impedance of the balancing network and the impedance of the sleeve dipole antenna match.

Figure 1:
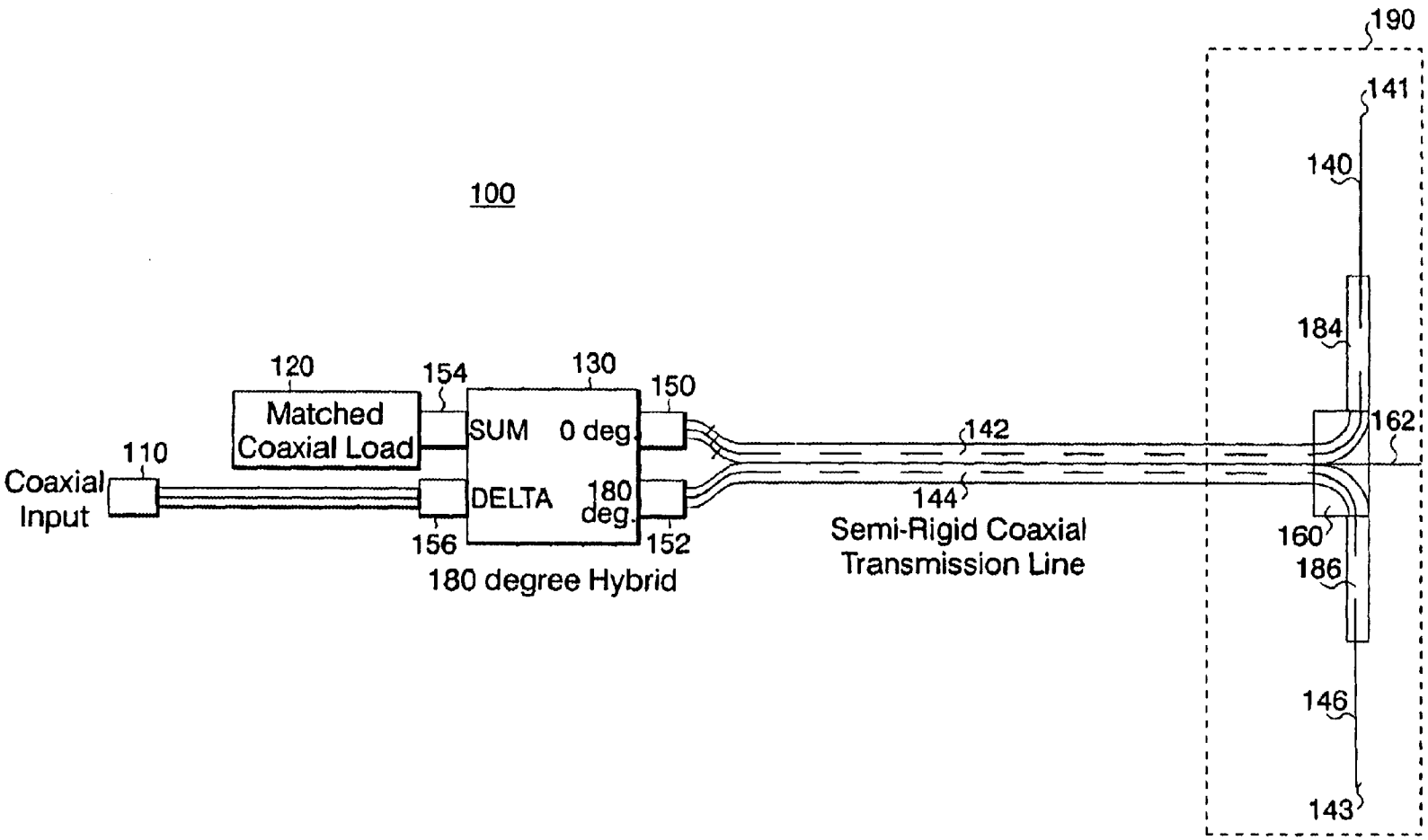
FIG. 1 is an exemplary embodiment of the present invention.

FIG. 1 represents one embodiment of the present invention 100. As can be seen in FIG. 1, the embodiment comprises both a balancing network 130 and a linear dipole antenna 190 or more specifically a sleeve dipole antenna. In FIG. 1 the balancing network 130 is represented as a 180-degree, four-port hybrid network, however other balancing networks could be effectively implemented. Some such hybrid networks include but are not limited to, four-port, and eight-port-hybrid networks. As can be seen in FIG. 1, the balancing network 130 has four ports 150, 152, 154, 156. The SUM port 154 is not used, it is terminated in a matched coaxial load 120. The SUM port 154 has an impedance of approximately 50Ω. The DELTA port 156 also has a 50Ω impedance. The DELTA port 156 behaves as an antenna input port when the antenna system is transmitting and behaves as an antenna output port when the antenna system is receiving. The two remaining ports 150, 152 are driven 180° out of phase with one another. The 0° port 150 is one hundred and eighty degrees out of phase with the 180° port 152. As with the DELTA port 156, the 0° and 180° ports 150, 152 or in other words the first 150 and second 152 ports respectively behave either as input or output ports depending on whether the antenna is transmitting or receiving. If the antenna is transmitting, the first and second ports 150, 152 behave as output ports. If the antenna is receiving the first and second ports 150, 152 behave as input ports.

The antenna system has two transmission lines 142, 144 which are removably connected to the first and second ports 150, 152 of the balancing network 130 respectively. The two transmission lines are coaxial. In addition, the antenna system has a sleeve dipole antenna 190 that has both inner conductors 140, 146 and outer conductors 184, 186 coaxially disposed. The inner conductors 140, 146 of the sleeve dipole antenna project from the outer conductors 184, 186 at a point so as to match the impedance of the balancing network at resonance. The inner conductors 140, 146 extend substantially one hundred and eighty degrees from each other respectively. The inner conductors 140, 146 are symmetric. The tip to tip length of the two ends 141, 143 of the sleeve dipole antenna 190 determine the resonance frequency of the antenna.

The sleeve dipole antenna 190 of the system is represented by the outer conductors 184, 186 and the projecting inner conductors 140,146. The length of the sleeve dipole antenna, free end 141 to free end 143, represents approximately one half the wavelength of the transmitting or receiving antenna system. Accordingly, as mentioned above the length of the sleeve dipole antenna, free end to free end 141 to 143 determines at which point the antenna resonates.

The edge of the outer conductors 184, 186 from which the inner conductors 140, 146 project create two symmetric feed regions 180 degrees apart from one another. Because these feed regions are symmetric, the favorable radiation pattern seen in linear dipoles is maintained. Because the feed regions are small, they facilitate high frequency antenna systems. Feed regions are related to wavelength. In order to prevent spurious radiation, feed regions must be a small fraction of total antenna's length. High frequency applications have small wavelengths and therefore mandate small feed regions. Thus, because the present invention creates arbitrarily small feed regions, the present invention easily functions for high frequency applications.

Whereas the length of the dipole, free end 141 to free end 143 relates to the frequency range of the antenna, the length of the dipole's outer conductors 184, 186 relates to the antenna's matching impedance at resonance. The outer conductors 184,186 scale the impedance. In prior art systems at resonance frequency the antenna's impedance, purely resistive, was approximately 73–80Ω. The present invention alters the length of the coaxial sleeve from a center point 162 of the sleeve dipole antenna to the edge where the inner conductor projects from inside the outer conductor. The length from center point to edge is designed so as to match the effective impedance of the feed source. Thus in one embodiment, the length of the coaxial sleeve from center point 162 to edge is chosen to match the 50Ω source impedance at each port of the balancing network.

Figure 2:
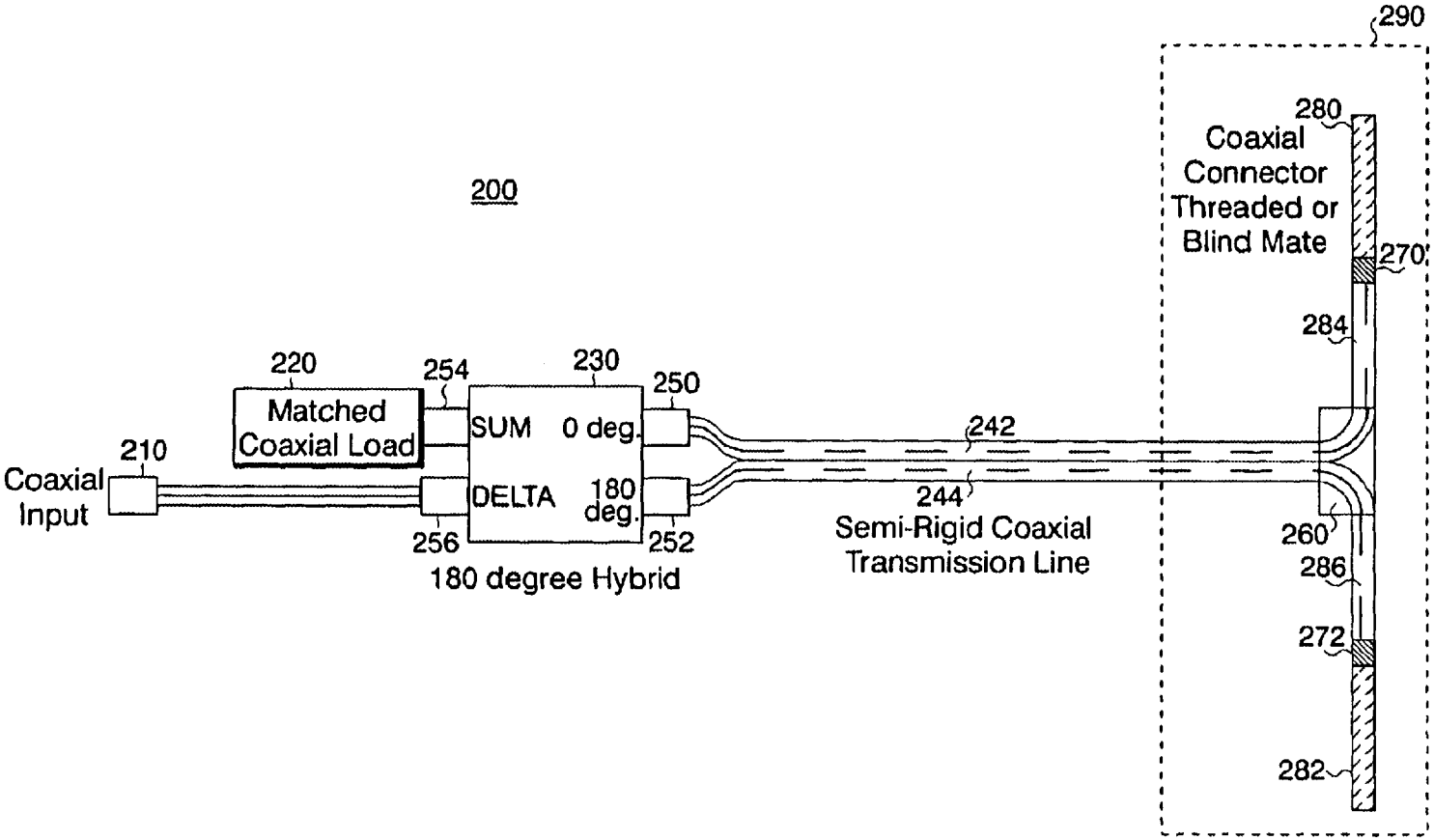
FIG. 2 is a further exemplary embodiment of the present invention.

FIG. 2 represents a further exemplary diagram of one embodiment of the present invention. As can be seen in FIG. 2, many components of the antenna system shown in FIG. 2 are similar to the system shown in FIG. 1. As before, the balancing network 230 is the 180-degree, four-port hybrid network. The matched coaxial load 220 is attached to the SUM port 254. Also as seen before, the 180-degree, four-port hybrid network 230 has two first and second ports 250, 252 which are 180° out of phase with one another. The first port 250 is driven to 0° while the second port 252 is driven to 180°. Also as seen in FIG. 1, the antenna system includes a sleeve dipole antenna 290. As in FIG. 1, the two transmission lines 242, 244 extend substantially parallel to each other until reaching a conductive base 260. At the conductive base 260, the balancing network 230 is connected through the transmission lines 242, 244 to the coaxial input ports of the sleeve dipole antenna 290. Whereas in FIG. 1, the inner conductors 140, 146 are visible, in FIG. 2, the inner conductors are hidden behind coaxial connectors 270, 272 and coaxial cables 280, 282. However, the inner conductors in FIG. 2 are still coaxially disposed within the outer conductors 284, 286 and similarly project from the outer conductors at the point where the dipole's impedance matches the impedance of the balancing network. FIG. 2 depicts how the antenna system of the present invention can be driven and "connectorized" to other devices. It should be noted that, while in FIG. 1 and FIG. 2, 180-degree hybrid networks 230 are demonstrated other non-radiating, completely closed, balancing networks can be used. Some examples of non-radiating, completely closed, balancing networks include, but are not limited, to shielded double-Y balun or Marchand shielded balun balancing networks.

Figure 3:
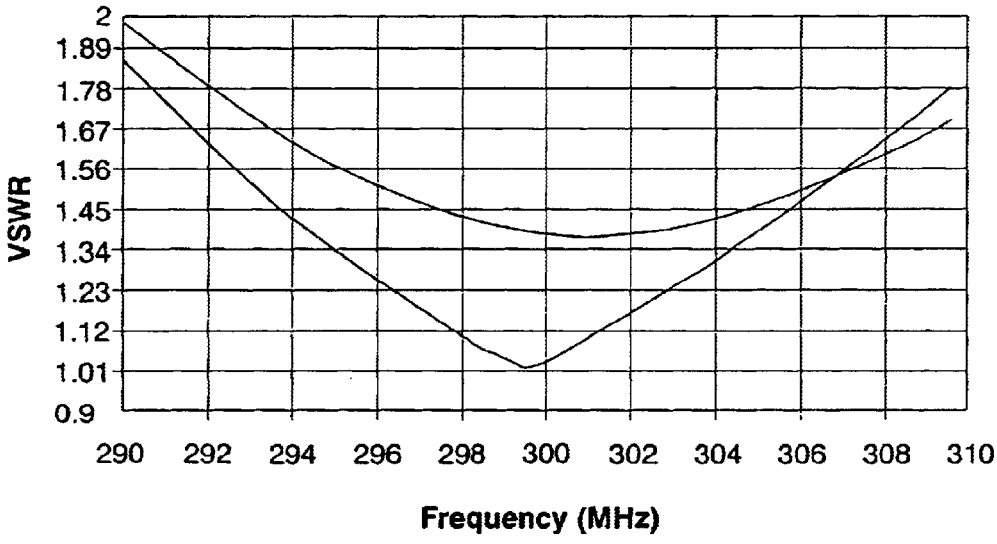
FIG. 3 is a graph depicting the voltage standing wave ratio versus the frequency as seen in prior art dipole antenna systems as compared to one embodiment of the present invention.

In FIG. 3, a graph depicting the voltage standing wave ratio versus frequency as seen in prior art antenna systems is compared to the present invention. The upper line represents the prior art. The lower line represents the present invention. As seen in FIG. 3, the resonance frequency or the low point on the VSWR vs. Frequency chart for both the prior art and present is just below 300 MHz. As seen in FIG. 3, at resonance frequency, the present invention has nearly a 1:1.01 or nearly a 1:1 VSWR. Note that this 1:1 VSWR ratio is obtained without the use of resistive pads or an external matching network. However, when looking to the upper line, representing the prior art, at resonance, the ratio is closer to 1:1.40. Thus, without the use of resistive matching pads the present invention obtains the favorable 1:1 VSWR.

Figure 4:
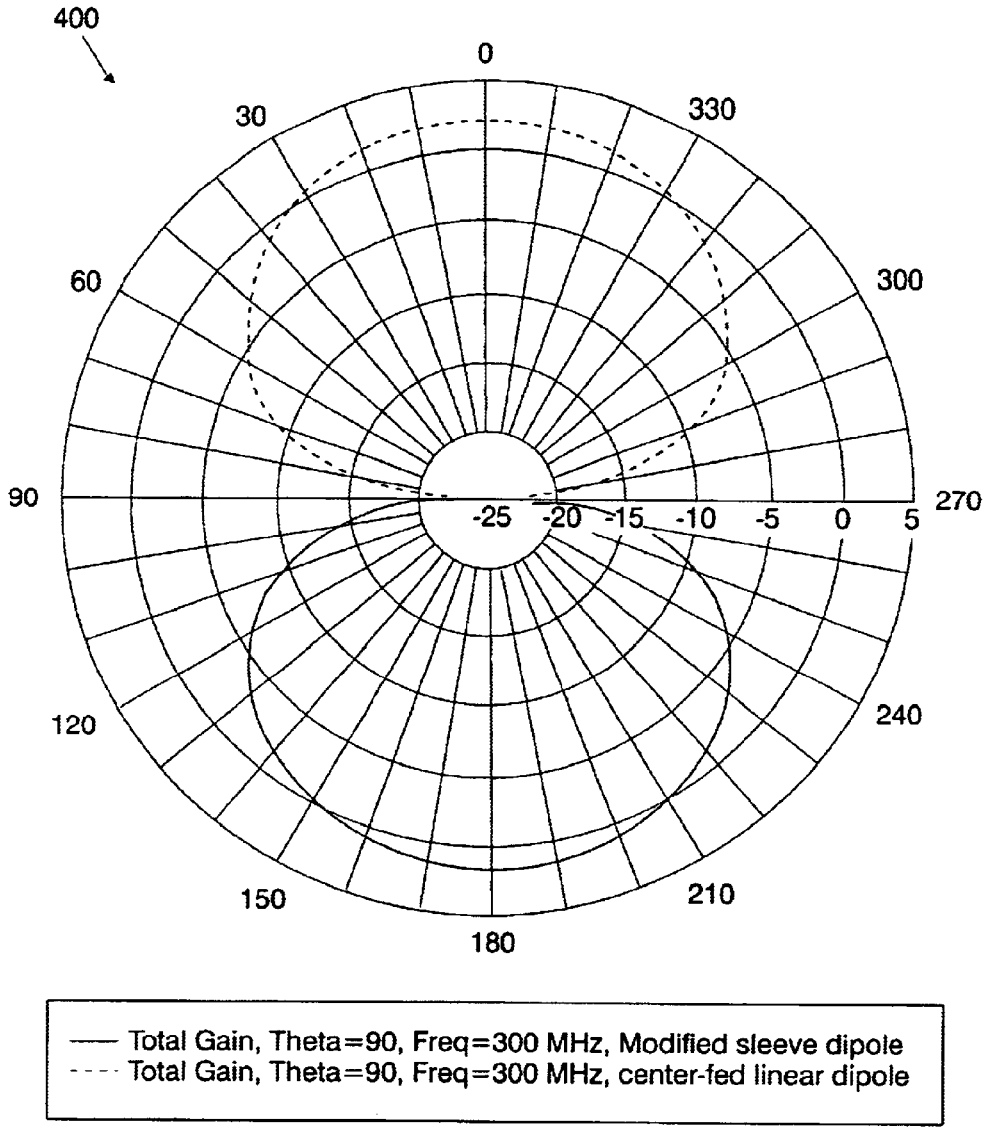
FIG. 4 represents a comparison of E-plane radiation patterns of the present invention and prior art antenna systems.
Figure 5:
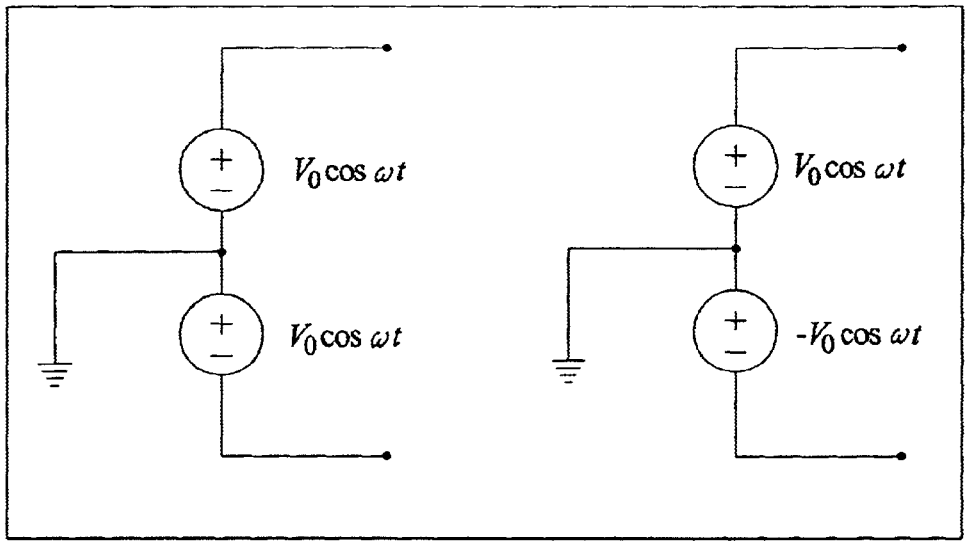
FIG. 5 represents two exemplary balanced sources.
Figure 6:
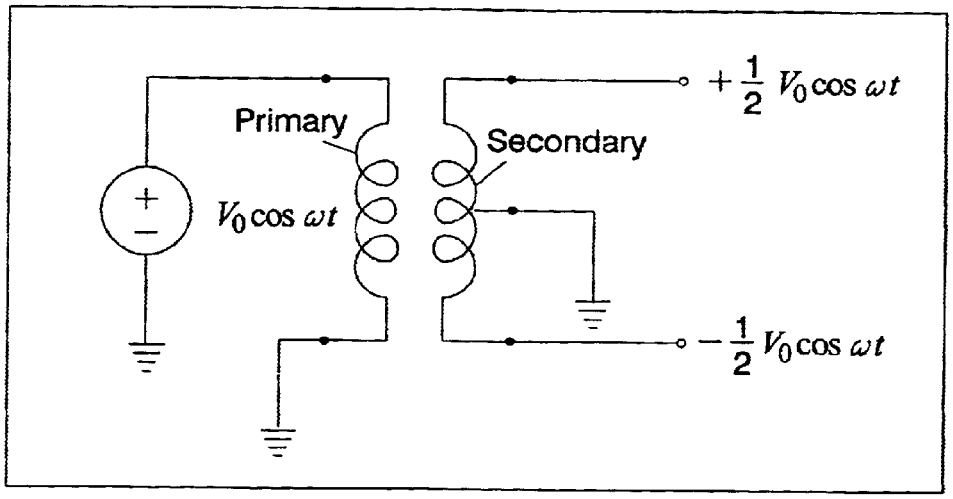
FIG. 6 represents a balanced source derived from a single ended or unbalanced source using a balun.

FIG. 4 depicts a comparison of the radiation patterns of the present embodiment versus canonical or idealized linear dipole antenna systems. The radiation performance of the present invention is demonstrated by the top rounded line, while the radiation performance of the canonical or idealized prior art linear dipole is demonstrated by the bottom rounded line. As can be seen in FIG. 4, there is no discernible difference in radiation patterns between the present invention and the canonical or idealized linear dipole. Thus, FIG. 4 demonstrates how the present embodiment preserves the radiation patterns of canonical or idealized liner dipoles.

Figure 7:
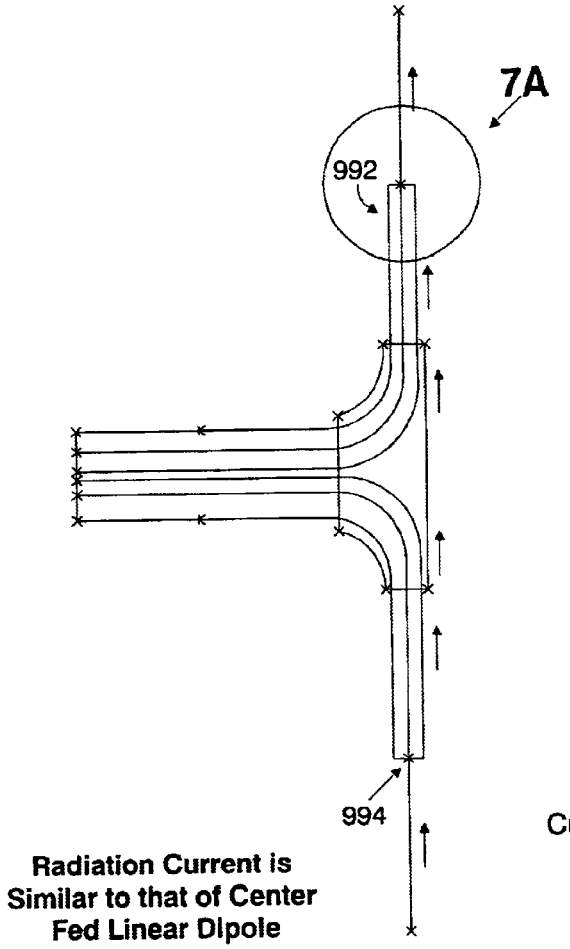
FIG. 7 further represents the feed regions of the antenna according to embodiment of the present invention.
Figure 7A:
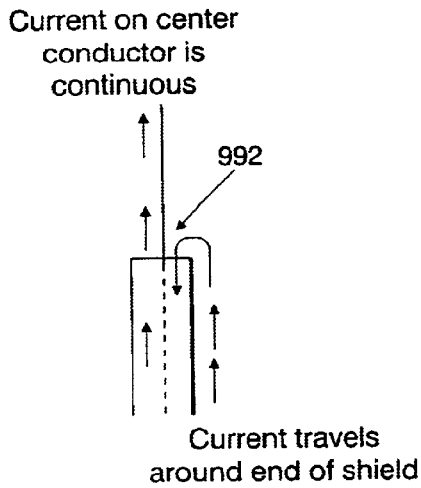
Figure 8:
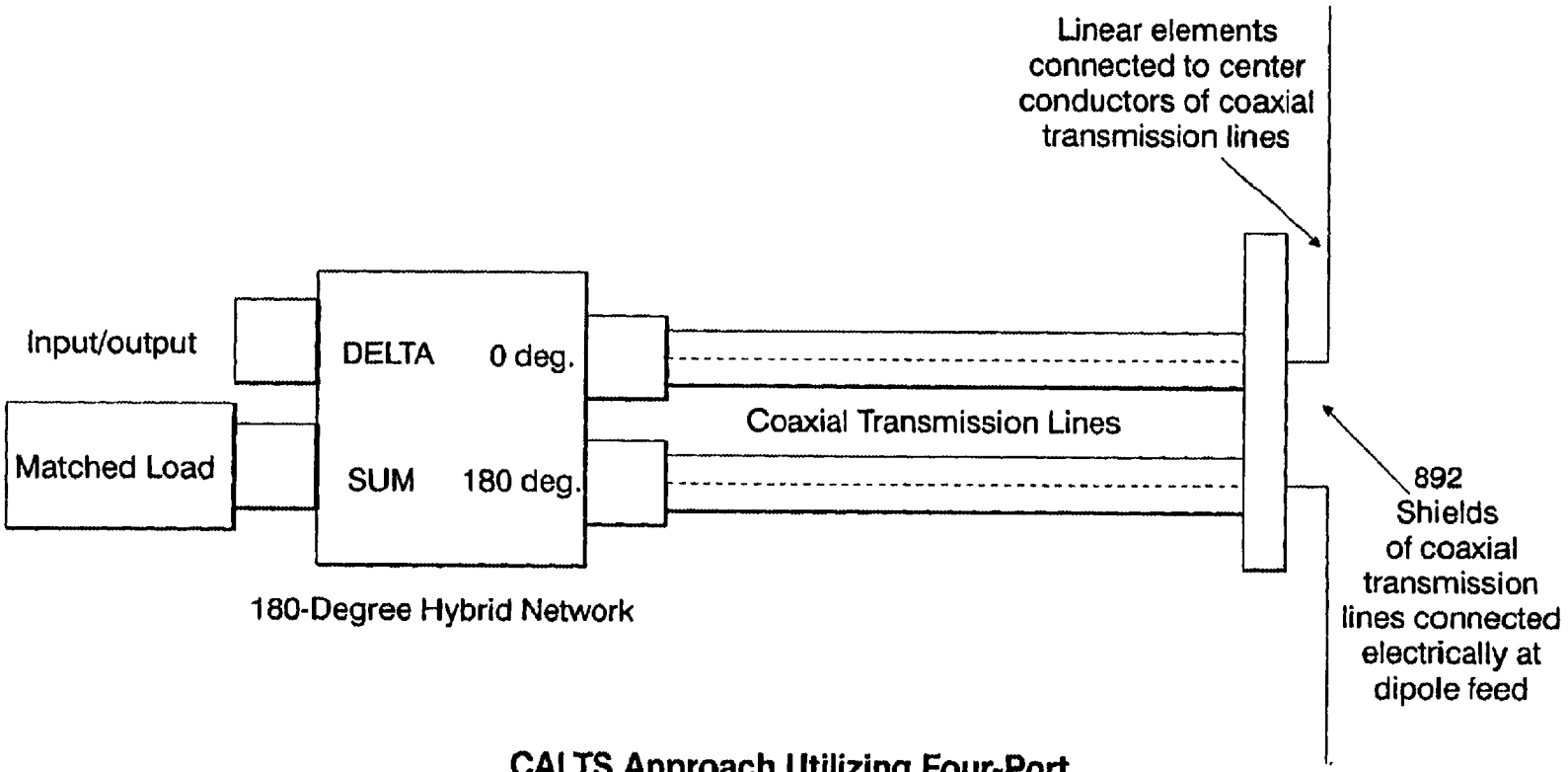
Figure 8 (Prior Art)
FIG. 8 depicts a prior art approach to the center fed linear dipole.
Figure 9:
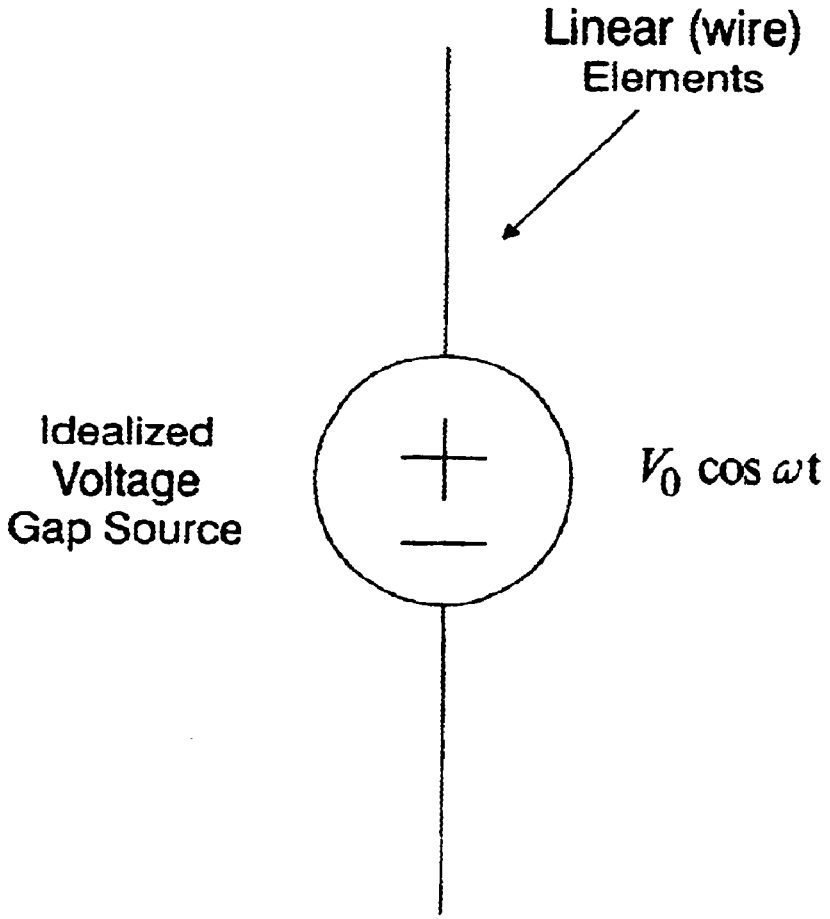
FIG. 9 depicts a canonical, idealized center-driven linear dipole.
Figure 10:
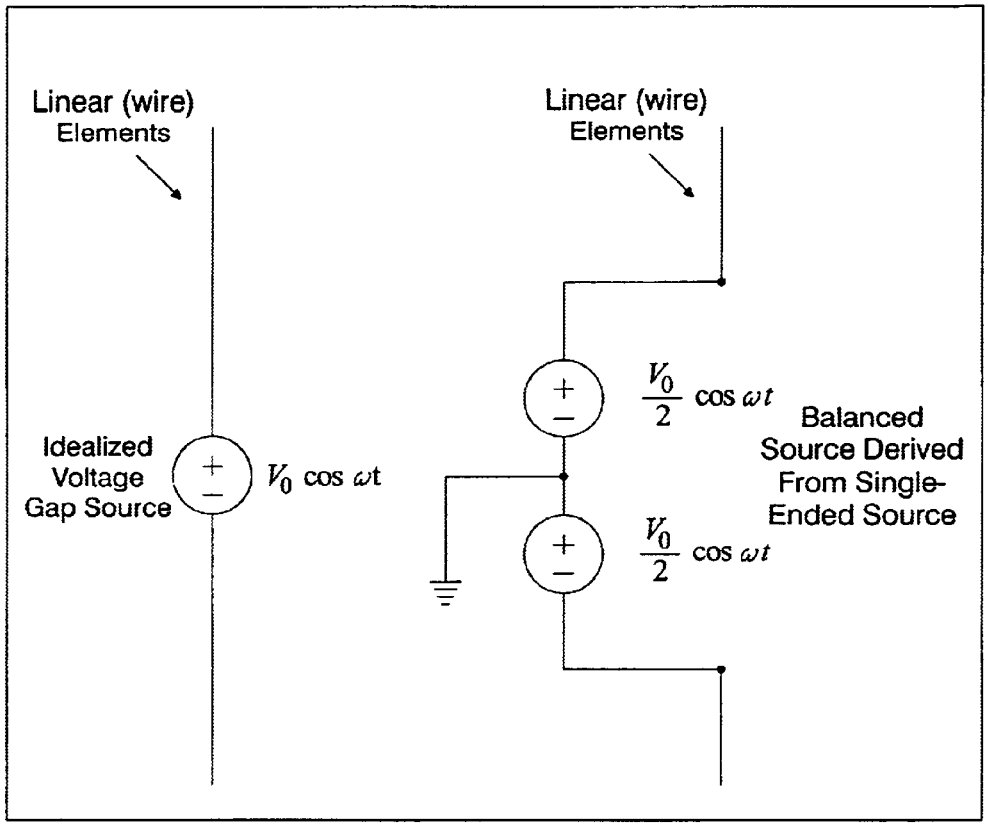
FIG. 10 depicts schematically the center-driven linear dipole in FIG. 9.
Figure 11:
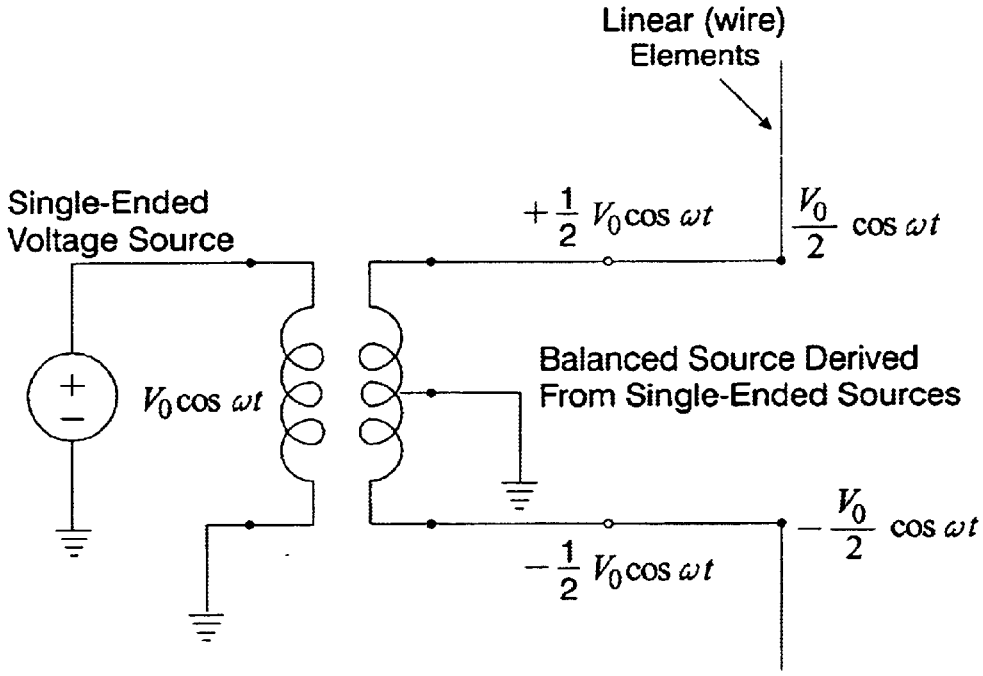
FIG. 11 further depicts the center driven linear dipole of FIG. 10.
Figure 12:
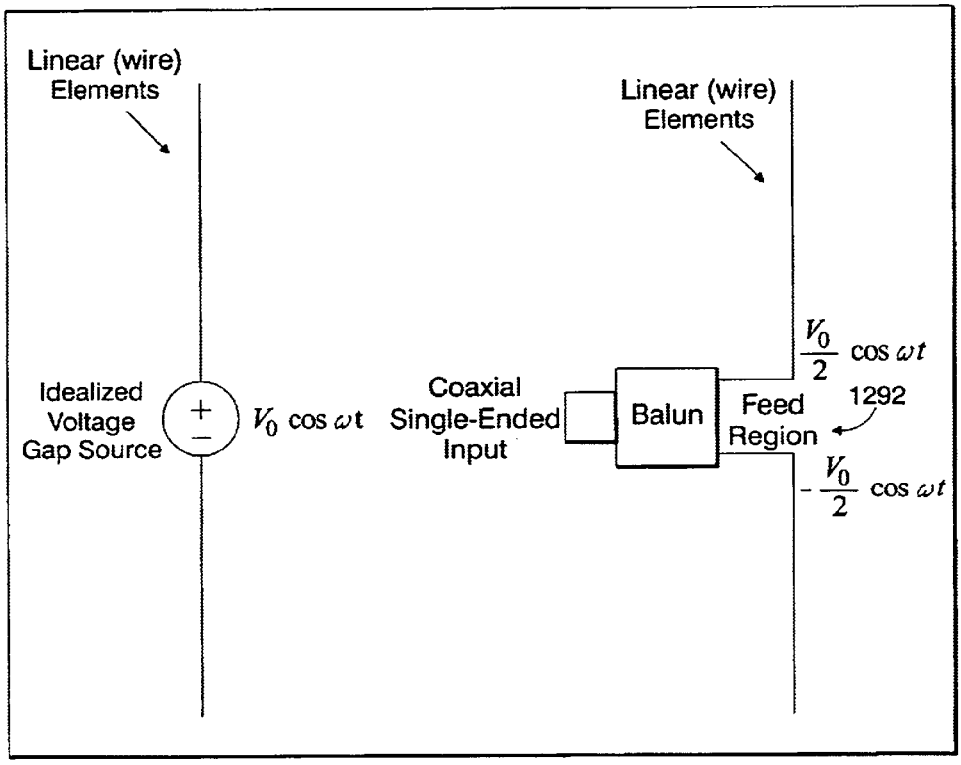
Figure 12 (Prior Art)
FIG. 12 depicts a prior art linear dipole antenna system.
Figure 13:
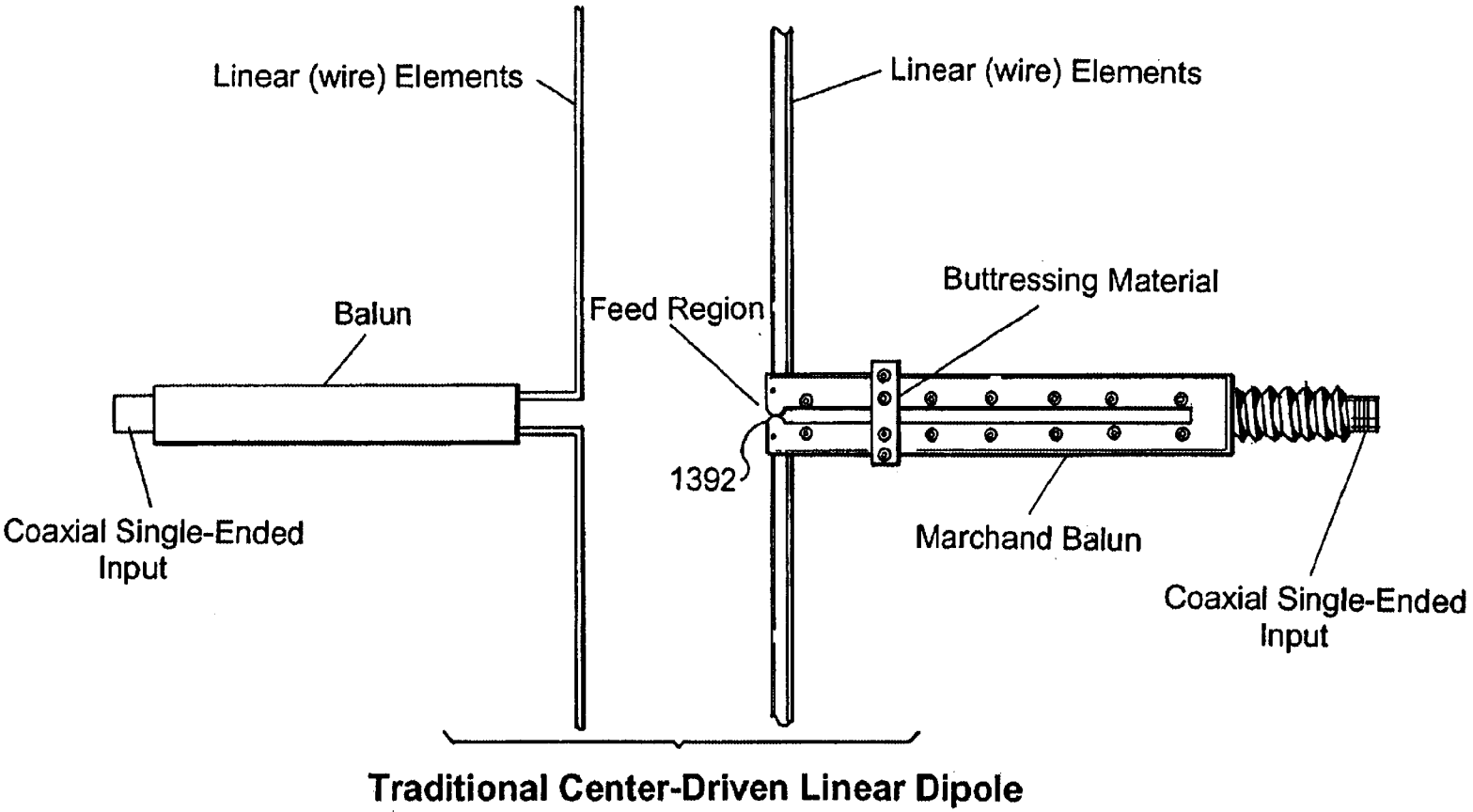
Figure 13 (Prior Art)
FIG. 13 depicts a prior art Marchand balun feeding a linear dipole antenna.
Figure 14:
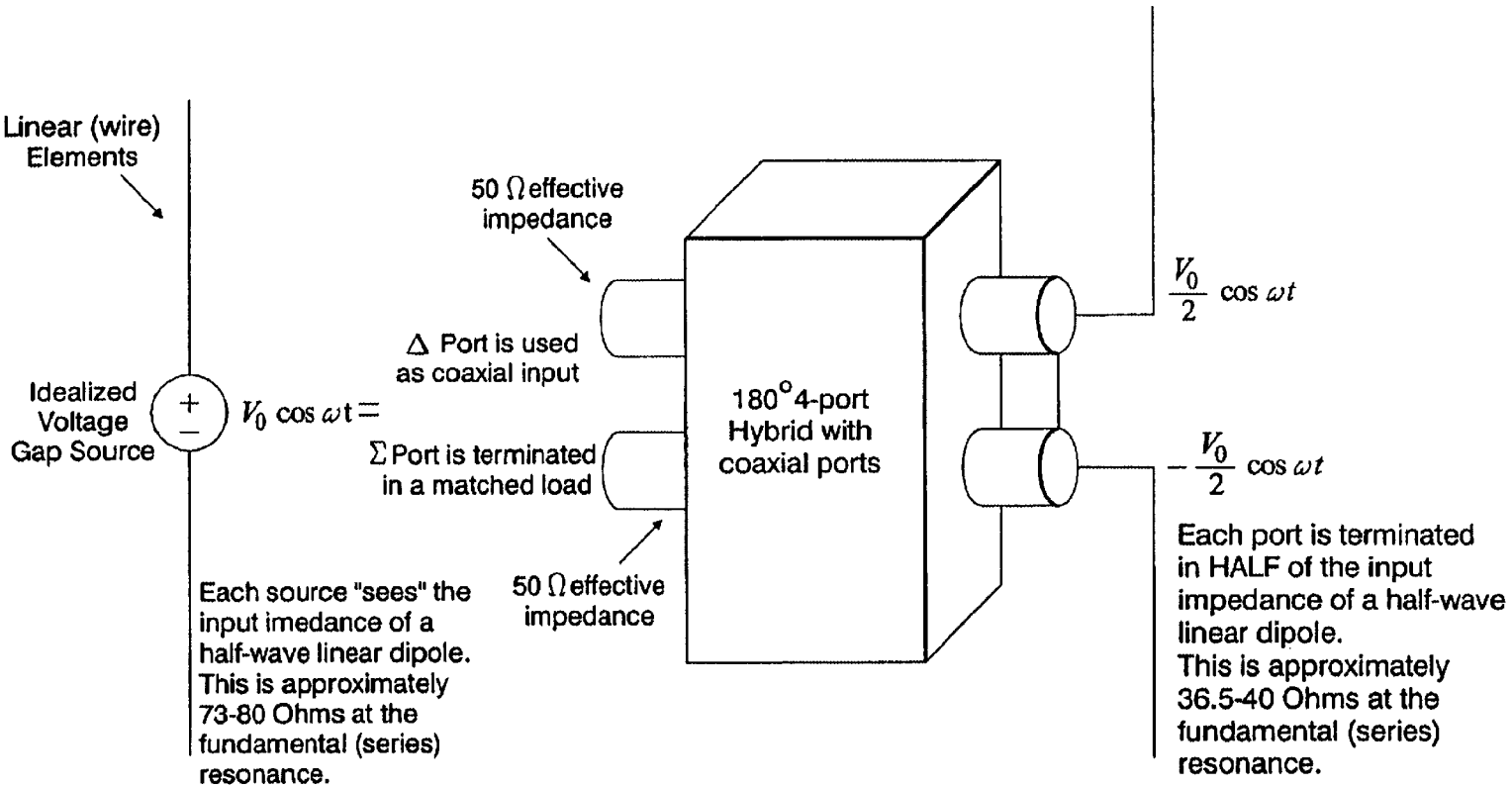
Figure 14 (Prior Art)
FIG. 14 depicts the prior art CALTS approach for a linear dipole antenna.
Figure 15:
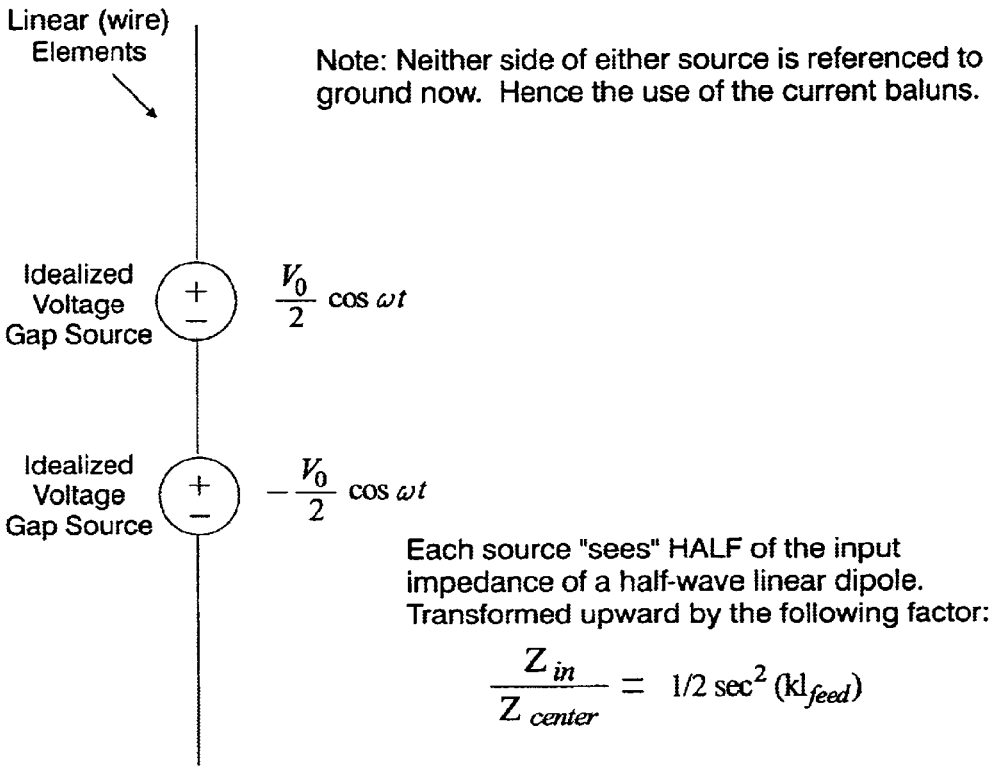
FIG. 15 depicts transforming impedance effects associated with moving the feed regions of a half-wave linear dipole.

FIG. 7 represents the feed regions of the sleeve dipole antenna according to one embodiment of the present invention. As mentioned above, the present invention has two arbitrarily small feed regions 992, 994 displaced from the dipole's center point. Also as mentioned above these arbitrarily small feed regions 992, 994 prevent spurious radiation and are accordingly useful in high frequency operations. As depicted in FIG. 7, the sleeve dipole antenna of the present embodiment has two inner conductors projecting from the first and second ends of two outer conductors. The inner conductors have first and second ends. At the point where the inner conductors project from the inner conductors of the sleeve dipole antenna two feed regions 992, 994 are created. In prior art models, there was a single feed region which could not match source impedances without resistive matching pads. FIGS. 8, 12 and 13 all depict the single feed region design of prior art antenna models. The feed regions 892, 1292, 1392 as shown in FIGS. 8, 12 and 13 all exist at the dipole's center point. With the present embodiment, the two feed regions are separated, co-linear and one hundred and eighty degrees apart from one another. Because the two feed regions 992, 994 are symmetric, the feed regions still allow the antenna to radiate as a linear dipole. Thus, the symmetry allows for the radiation pattern of the present invention to match the radiation pattern of prior art linear dipole designs as demonstrated in FIG. 4. In addition, as seen in FIG. 7, by driving the impedance upward or in the other words by displacing the two feed regions away from the center point of the dipole, the source impedance can be matched to the dipole impedance without the use of matching pads.

While the invention has been particularly shown and described with reference to preferred embodiments thereof, it will be understood by those skilled in the art that various changes in form and details may be made therein without departing from the spirit and scope of the invention.

I claim:

1. An antenna system intrinsically matching a resistive impedance of a balancing network, the balancing network having a first output port and a second output port driven substantially one hundred and eighty degrees out of phase with respect to one another, comprising:

a first transmission line connected to the first output port of the balancing network at a first end, the first transmission line having a free end, the first transmission line including an inner conductor and a coaxially disposed outer conductor;

a second transmission line connected to the second output port of the balancing network, the second transmission line having a free end, the second transmission line extending from the balancing network co-linearly with respect to the first transmission line, the second transmission line including an inner conductor and a coaxially disposed outer conductor; and a sleeve dipole antenna having a resistive impedance at resonance, the sleeve dipole having a first input port and a second input port, the free end of the first transmission line connected to the first input port of the sleeve dipole, the free end of the second transmission line connected to the second input port of the sleeve dipole, the sleeve dipole having two feed regions, the feed regions displaced from the point of connection of the sleeve dipole to the first and second transmission lines, the feed regions displaced so that the resistive impedance of the sleeve dipole at resonance matches the resistive impedance at the first and second output ports of the balancing network.

2. An antenna system as in claim 1, wherein the transmission lines are semi-rigid coaxial cable.

3. An antenna system as in claim 1, wherein the balancing network is a shielded 180-degree, four-port hybrid network.

4. An antenna system as in claim 1, wherein the balancing network is a shielded Marchand balun.

5. An antenna system as in claim 1, wherein the balancing network is a shielded Roberts balun.

6. An antenna system as in claim 1, wherein the balancing network is a shielded choke balun.

7. An antenna system as in claim 1, wherein the balancing network is a shielded split sleeve balun.

8. An antenna system as in claim 1, wherein the antenna system is a metrology antenna system.

9. An antenna system for connecting to a balancing network, comprising:

a first transmission line removably connected to a first output of the balancing network at a first end, the first transmission line having a free end;

a second transmission line removably connected to a second output of the balancing network at a first end, the second transmission line having a free end; and, a sleeve dipole antenna having a first coaxial input port and a second coaxial input port, the free end of the first transmission line connected to the first coaxial input port of the sleeve dipole antenna and the free end of the second transmission line connected to the second coaxial input port of the sleeve dipole antenna, further comprising a first and second coaxial connector, the first coaxial connector removably connected to the sleeve dipole at a first end with a first mate, and the second coaxial connector removably connected to the sleeve dipole at a second end with a second mate.

10. An antenna system as in claim 9, wherein the first and second mates are threaded.

11. An antenna system as in claim 9, wherein the first and second mates are blind.

12. An antenna system as in claim 9, wherein the first and second transmission lines are made of semi-rigid material.

13. An antenna system for connecting to a balancing network, the balancing network having a first output port and a second output port, comprising:

a sleeve dipole antenna having a first inner conductor, a first outer conductor, a second inner conductor and a second outer conductor, the first inner conductor coaxially disposed within the first outer conductor until a first feed region, the first feed region created where the first inner conductor projects from the first outer conductor, the second inner conductor coaxially disposed within the second outer conductor until a second feed region, the second feed region created where the second inner conductor projects from the second outer conductor;

a first coaxial cable, the first coaxial cable connects and extends from a center point of the sleeve dipole antenna; and, a second coaxial cable, the second coaxial cable connects and extends symmetrically with respect to the first coaxial cable from the center point of the sleeve dipole antenna wherein the first and second feed regions are displaced so that a resistive impedance of the sleeve dipole antenna at resonance matches a resistive impedance at the first and second output ports of the balancing network.

14. An antenna system as in claim 13, wherein the first feed region is displaced from the antenna center point.

15. An antenna system as in claim 14, wherein the second feed region is displaced from the antenna center point.

16. An antenna system as in claim 13, wherein the first and second feed regions create an impedance at resonance of the dipole which matches the resistive impedance of the balancing network.

17. An antenna system as in claim 13, wherein the balancing network is a shielded 180-degree, four port hybrid network.

18. An antenna system as in claim 13, wherein the balancing network is a shielded Marchand balun.

19. An antenna system as in claim 13, wherein the balancing network is a shielded choke balun.

20. An antenna system as in claim 13, wherein the balancing network is a shielded split sleeve balun.

* * * * *